US008757742B2

(12) United States Patent
McDaniel

(10) Patent No.: US 8,757,742 B2
(45) Date of Patent: Jun. 24, 2014

(54) ADJUSTABLE RACK ASSEMBLY FOR USE WITH A WASHING APPLIANCE

(75) Inventor: Aaron Matthew McDaniel, Louisville, KY (US)

(73) Assignee: General Electric Company, Schenectady, NY (US)

( * ) Notice: Subject to any disclaimer, the term of this patent is extended or adjusted under 35 U.S.C. 154(b) by 384 days.

(21) Appl. No.: 12/957,943

(22) Filed: Dec. 1, 2010

(65) Prior Publication Data

US 2012/0139399 A1 Jun. 7, 2012

(51) Int. Cl.
*A47B 77/08* (2006.01)

(52) U.S. Cl.
USPC ..... 312/228.1; 312/334.4; 312/311; 211/41.8

(58) Field of Classification Search
USPC ..... 312/408, 228, 228.1, 299, 301, 321, 312/334.1, 334.7, 350, 311; 108/106, 107, 108/109, 144.11; 211/41.8, 41.4–41.6, 106, 211/133.1, 133.2, 133.5; 134/56 D, 57 D, 134/58 D
See application file for complete search history.

(56) References Cited

U.S. PATENT DOCUMENTS

| | | | | | |
|---|---|---|---|---|---|
| 1,851,192 | A * | 3/1932 | Lange | 126/339 |
| 1,934,125 | A * | 11/1933 | Hurt | 99/446 |
| 2,671,004 | A * | 3/1954 | Chadwick et al. | 312/350 |
| 3,373,754 | A * | 3/1968 | Squire | 134/58 D |
| 3,726,581 | A * | 4/1973 | Doepke | 312/351 |
| 3,791,371 | A * | 2/1974 | Oatley | 126/339 |
| 3,809,450 | A * | 5/1974 | Guth | 312/351 |
| 3,892,453 | A * | 7/1975 | Daily | 312/351 |
| 4,437,715 | A * | 3/1984 | Jenkins | 312/228.1 |
| 5,474,378 | A * | 12/1995 | Smith et al. | 312/334.4 |
| 5,657,878 | A * | 8/1997 | Austin | 211/41.8 |
| 5,860,716 | A * | 1/1999 | Good et al. | 312/311 |
| 6,431,377 | B1 * | 8/2002 | Lechman | 211/133.2 |
| 6,666,218 | B2 | 12/2003 | Lavoie et al. | |
| 6,755,490 | B2 * | 6/2004 | Welch et al. | 312/228.1 |
| 6,974,040 | B2 * | 12/2005 | Jahrling | 211/41.8 |
| 7,410,228 | B2 | 8/2008 | Dickson et al. | |
| 7,815,265 | B2 * | 10/2010 | Lee | 312/228.1 |
| 8,192,557 | B2 * | 6/2012 | Ryu et al. | 134/56 D |
| 2004/0103932 | A1 * | 6/2004 | Kim | 134/137 |
| 2005/0133469 | A1 * | 6/2005 | Mersch et al. | 211/41.8 |
| 2006/0119236 | A1 * | 6/2006 | Dickson et al. | 312/311 |
| 2008/0272072 | A1 * | 11/2008 | Tynes et al. | 211/41.8 |
| 2009/0058238 | A1 * | 3/2009 | Lee | 312/228.1 |
| 2011/0018410 | A1 * | 1/2011 | Bastuji et al. | 312/228.1 |
| 2012/0248955 | A1 * | 10/2012 | Rehage et al. | 312/334.1 |

* cited by examiner

*Primary Examiner* — Daniel Rohrhoff
(74) *Attorney, Agent, or Firm* — Global Patent Operation; Marc A. Vivenzio

(57) ABSTRACT

An adjustable rack assembly for a washing appliance. The adjustable rack assembly includes a rack having a first side wall and an opposing second side wall, a first rail assembly having a first plurality of horizontal rails, and a second rail assembly having a second plurality of horizontal rails. A first support assembly is coupled to the first side wall of the rack and includes a first support plate configured to be removably coupled to the first rail assembly at a first horizontal rail of the first plurality of horizontal rails. A second support assembly is coupled to the second side wall of the rack and includes a second support plate configured to be removably coupled to the second rail assembly at a first horizontal rail of the second plurality of horizontal rails.

12 Claims, 7 Drawing Sheets

ADJUSTABLE RACK ASSEMBLY FOR USE WITH A WASHING APPLIANCE

BACKGROUND OF THE INVENTION

The embodiments described herein relate generally to racks for use with washing appliances and, more particularly, to an adjustable rack assembly for use with a washing appliance.

At least some known washing appliances are dishwashers with at least two racks for supporting items within a tub of the dishwasher. At least some known dishwasher upper racks are adjustable within the tub to different heights. Such known adjustable upper racks are movable to a top position and to a bottom position using a vertical slider with a locking lever. More specifically, a vertical slider is coupled to each side wall of the rack, and the lever is biased to a locking position. To adjust the height of the rack, the lever is pulled away from the vertically slider to an unlocked position and the rack is slid along the vertical slider. However, holding the lever in the unlocked position while attempting the move the rack vertically can be difficult. Further, the vertical slider and locking lever only allow the rack to be positioned at two different heights.

Moreover, such adjustable upper racks are coupled to the side walls of the tub at horizontal slider assemblies. More specifically, each slider assembly includes rollers coupled to the side walls at a fixed height. The upper rack is movable into and out of the tub along the rollers. Because the rollers are coupled at a fixed height, the height of the rack is adjusted with respect to the horizontal slider assembly, and the height of the horizontal slider assembly cannot be adjusted. Additionally, the upper rack cannot be removed from the horizontal slider assembly for removal from the tub.

Another known adjustable rack system includes a rack having three rows of wheels positioned with respect to each side wall of the rack. More specifically, at least an upper row, a middle row, and a lower row of wheels are coupled to each side wall. A slide is coupled to each side wall of a tub of the dishwasher. The rack can be positioned on the slides such that the slide is between the upper and middle rows of wheels or between the middle and lower rows of wheels. However, such a rack system requires a user to completely remove the rack from the slide and re-position the rack on the slide by inserting the slide between two rows of wheels.

BRIEF SUMMARY OF THE INVENTION

In one aspect, an adjustable rack assembly for use with a washing appliance is provided. The adjustable rack assembly includes a rack having a first side wall and an opposing second side wall, a first rail assembly having a first plurality of horizontal rails, and a second rail assembly having a second plurality of horizontal rails. A first support assembly is coupled to the first side wall of the rack and includes a first support plate configured to be removably coupled to the first rail assembly at a first horizontal rail of the first plurality of horizontal rails. A second support assembly is coupled to the second side wall of the rack and includes a second support plate configured to be removably coupled to the second rail assembly at a first horizontal rail of the second plurality of horizontal rails.

In another aspect, a washing appliance is provided. The washing appliance includes a tub having a first side wall and a second side wall, wherein the tub is in flow communication with a water source, and a rack assembly coupled within the tub. The rack assembly includes a rack having a first side wall and an opposing second side wall, a first rail assembly coupled to the first side wall of the tub, and a second rail assembly coupled to the second side wall of the tub. The first rail assembly includes a first plurality of horizontal rails, and the second rail assembly includes a second plurality of horizontal rails. A first support assembly is coupled to the first side wall of the rack and includes a first support plate configured to be removably coupled to the first rail assembly at a first horizontal rail of the first plurality of horizontal rails. A second support assembly is coupled to the second side wall of the rack and includes a second support plate configured to be removably coupled to the second rail assembly at a first horizontal rail of the second plurality of horizontal rails.

In yet another aspect, an adjustable rack assembly for use with a washing appliance is provided. The adjustable rack assembly includes a rack having a first side wall and an opposing second side wall. The adjustable rack assembly further includes a first rail assembly having a first plurality of horizontal rails and a second rail assembly having a second plurality of horizontal rails. A first support assembly is configured to couple to the first side wall of the rack and includes a first support plate configured to be removably coupled to the first rail assembly at a first horizontal rail of the first plurality of horizontal rails. A second support assembly is configured to couple to the second side wall of the rack and includes a second support plate configured to be removably coupled to the second rail assembly at a first horizontal rail of the second plurality of horizontal rails.

BRIEF DESCRIPTION OF THE DRAWINGS

FIG. 1 is a partially broken-away side view of an exemplary washing appliance in a closed configuration.

FIG. 2 is a front view of the washing appliance shown in FIG. 1 in an open configuration.

FIG. 3 is a side perspective view of a rail assembly that may be used with the washing appliance shown in FIGS. 1 and 2.

FIG. 4 is a top view of an adjustable rack assembly that may be used with the washing appliance shown in FIGS. 1 and 2.

FIG. 5 is a cross-sectional view of the adjustable rack assembly shown taken at line 5-5 in FIG. 4.

FIG. 6 is a side view of a support assembly that may be used with the adjustable rack assembly shown in FIGS. 4 and 5.

FIG. 7 is a cross-sectional view of the support assembly shown in FIG. 6.

FIG. 8 is a flowchart illustrating an exemplary method for manufacturing the washing appliance shown in FIGS. 1-7.

FIG. 9 is a side view of the adjustable rack assembly shown in FIGS. 4-7 in an extended position.

FIG. 10 is a side view of the adjustable rack assembly shown in FIGS. 4-7 in a removable position.

DETAILED DESCRIPTION OF THE INVENTION

The embodiments described herein provide an adjustable rack assembly for supporting at least an upper rack of a dishwasher at a user-selected height within a tub of the dishwasher. More specifically, the adjustable rack assembly described herein includes a plurality of opposing pairs of rails spaced from side walls of the tub. The rack is positioned on a selected pair of rails and removably coupled thereto. The adjustable rack assembly enables a user to quickly and easily install the rack at various heights and remove the rack. More specifically, the rack is installed on any of the horizontal rails by first sliding support plates, using back rollers on the rails, at a slight angle to the rails until the rack is within the tub. The rack is positioned substantially parallel to the rails, and the support rails are coupled to the rails at front and back offsets. Further, the adjustable support assembly includes slide assemblies that enable the rack to be moved to an extended position to load items on to the rack for washing.

The rack can be quickly and easily removed, installed, and/or carried with two hands. As such, the user can use the rack as an external rack before and after the items are washed within the dishwasher. For example, the user can position the rack on a counter or within a storage cabinet when filling the rack or putting washed items away.

Figure 1:
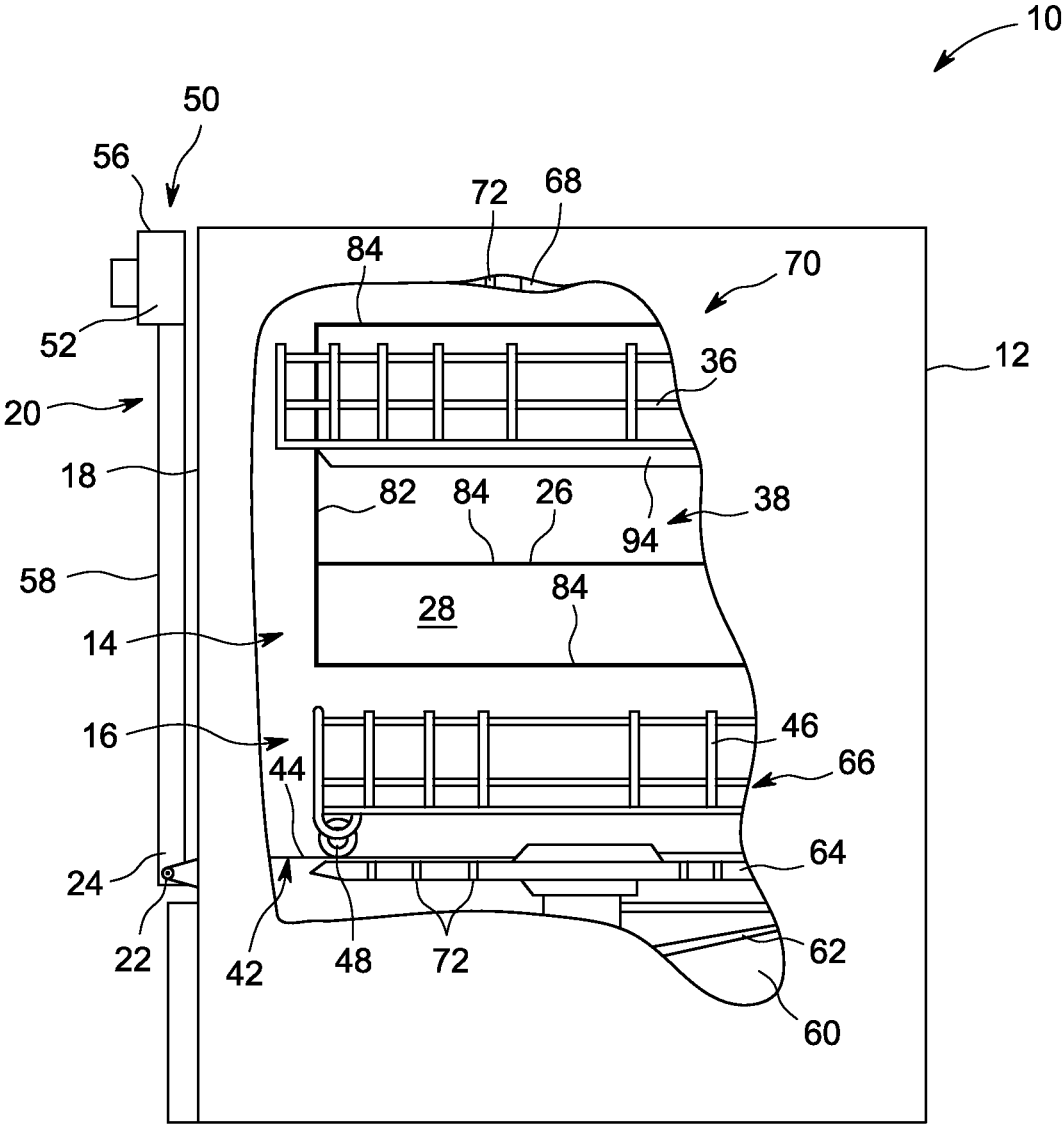
FIGS. 1-10 show exemplary embodiments of the systems and method described herein.
Figure 2:
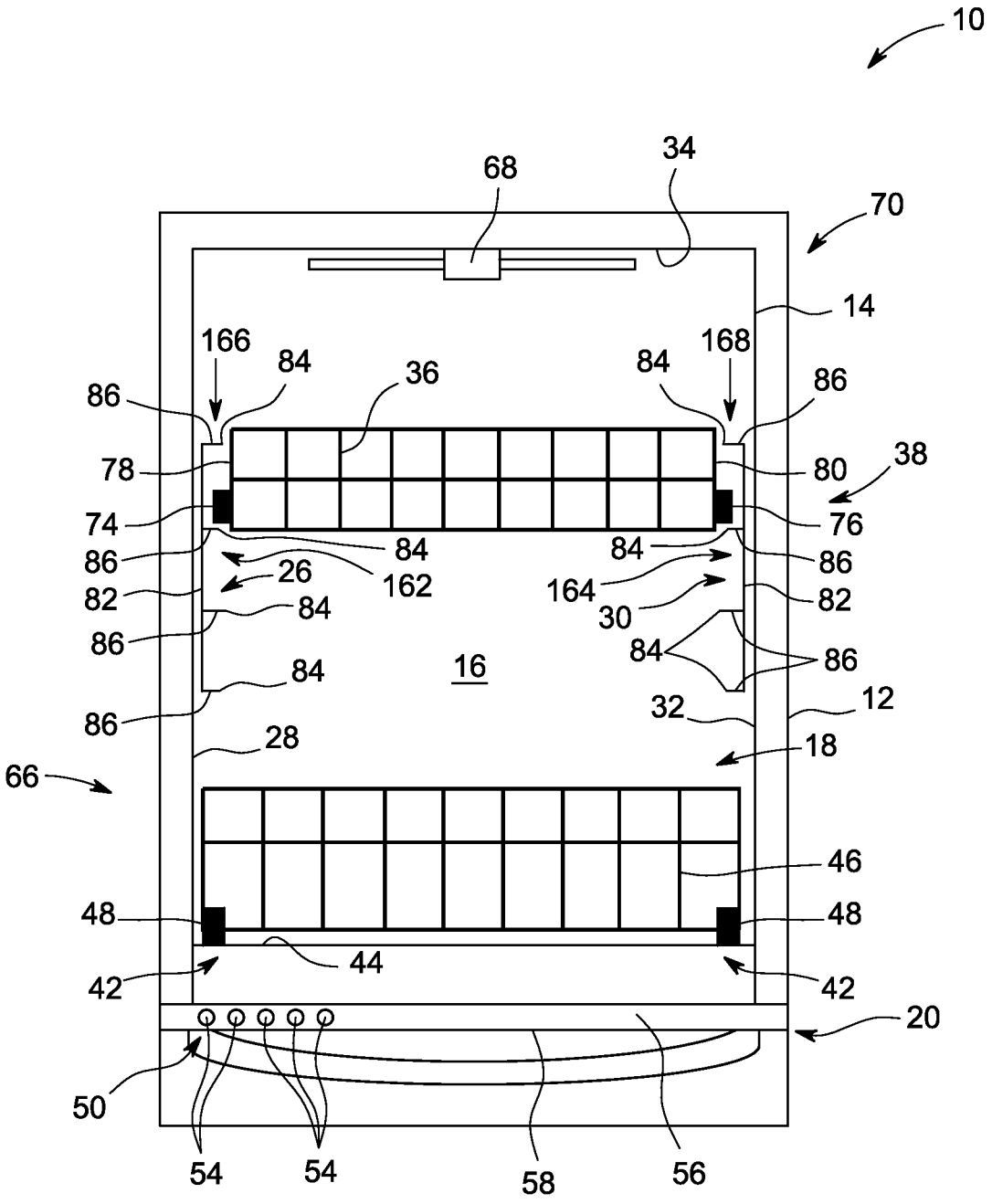

FIG. 1 is a partially broken-away side view of an exemplary washing appliance 10 in a closed configuration. FIG. 2 is a front view of washing appliance 10 in an open configuration. In the exemplary embodiment, washing appliance 10 is a dishwashing appliance. It should be understood that the methods and apparatus described herein can be practiced in other types of dishwashers and washing appliances beyond washing appliance 10. Accordingly, the following description is for illustrative purposes only, and the methods and apparatus herein described are in no way limited to use in a particular application, or to a particular type of appliance, such as, for example, washing appliance 10.

Washing appliance 10 includes a cabinet 12 having a tub 14 therein and forming a wash chamber 16. Tub 14 includes a front opening 18 and a door assembly 20 pivotally attached by a hinge 22 at a bottom 24 of door assembly 20. Door assembly 20 is moveable between a closed position (shown in FIG. 1) in which wash chamber 16 is sealed shut for washing operation, and an open position (shown in FIG. 2) for loading and unloading contents of washing appliance 10. A first rail assembly 26 is coupled to a first side wall 28 of tub 14, and a second rail assembly 30 is coupled to a second side wall 32 of tub 14. Alternatively, or additionally, rail assembly 26 and/or 30 is coupled to a top wall 34 of tub 14. First rail assembly 26 and second rail assembly 30 are substantially similar and are described in more detail below. An upper rack 36 is removably coupled to rail assemblies 26 and 30, as described in more detail below. Upper rack 36 and rail assemblies 26 and 30 form an adjustable rack assembly 38. Upper rack 36 includes a front handle 40 (shown in FIG. 4) to facilitate adjusting a height of upper rack 36 within tub 14 and/or moving upper rack 36 with respect to tub 14.

In the exemplary embodiment, lower guide rails or channels 42 are coupled to side walls 28 and/or 32 and/or a bottom wall 44 of tub 14. A lower rack 46 is positioned on and/or in lower guide channels 42 for movement into and out of tub 14. Alternatively, washing appliance 10 does not include lower channels 42 and lower rack 46 is movable along bottom wall 44. In the exemplary embodiment, lower rack 46 includes wheels or rollers 48 that enable lower rack 46 to be inserted into and removed from tub 14 along lower channel 42. In an alternative embodiment, lower rack 46 includes any suitable mechanism, such as a slider, that enables lower rack 46 to be moveable into and out of tub 14.

Upper rack 36 and lower rack 46 are each fabricated from known materials that are formed into lattice structures having a plurality of elongate members. Further, each rack 36 and 46 is movable between an extended loading position (shown in FIG. 9) substantially outside of wash chamber 16, and a retracted position (shown in FIG. 1) substantially inside wash chamber 16. A silverware basket (not shown) can be removably attached to lower rack 46 for placement of silverware, utensils, and the like that are too small to be accommodated by upper rack 36 and/or lower rack 46.

A control panel 50 is integrated into an escutcheon 52 that is mounted to door assembly 20. Control panel 50 includes a plurality of control selectors 54 and/or a control display (not shown) defined on a top face 56 of door assembly 20. Alternatively, or additionally, selectors 54 and/or the control display are defined at any suitable location on washing appliance 10, such as an outer face 58 of door assembly 20. Control panel 50 and associated selectors 54 and/or displays are coupled to known control circuitry (not shown) and control mechanisms (not shown) for operating a fluid circulation assembly (not shown) that circulates water and detergent within tub 14. The fluid circulation assembly is located in a machinery compartment 60 positioned below a bottom sump portion 62 of tub 14. The construction and operation of the fluid circulation assembly is well within the purview of those skilled in the art without detailed explanation, and further discussion of the fluid circulation assembly is therefore omitted.

A lower spray assembly 64 is rotatably mounted within a lower region 66 of wash chamber 16 and above sump portion 62 so as to rotate in relatively close proximity to lower rack 46. An upper spray assembly 68 is located in an upper region 70 of wash chamber 16 in close proximity to upper rack 36. In a particular embodiment, a height of upper spray assembly 68 is adjustable. In an alternative embodiment, a middle spray arm assembly (not shown) is located between upper rack 36 and lower rack 46. The middle spray arm assembly is an alternative to, or in an addition to, upper spray assembly 68. In the exemplary embodiment, lower spray assembly 64 and upper spray assembly 68 are supplied with fluid, such as water, by the fluid circulation assembly. Each spray assembly 64 and 68 includes an arrangement of discharge ports 72 for directing the fluid on to contents of lower rack 46 and/or upper rack 36. An arrangement of discharge ports 72 in at least lower spray assembly 64 provides a rotational force by virtue of the fluid flowing through discharge ports 72. The resultant rotation of lower spray assembly 64 provides coverage of the dishwasher contents with a washing spray. In various alternative embodiments, upper spray assembly 68 is also rotatably mounted and configured to generate a swirling spray pattern above upper rack 36 when the fluid circulation assembly is activated and door assembly 20 is properly closed to seal wash chamber 16 for operation.

Figure 3:
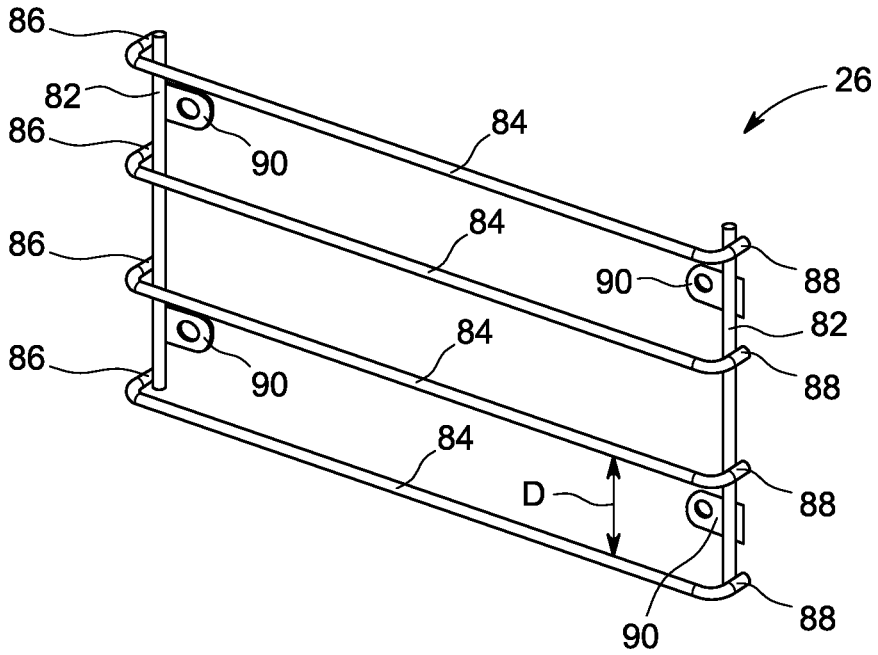
Figure 4:
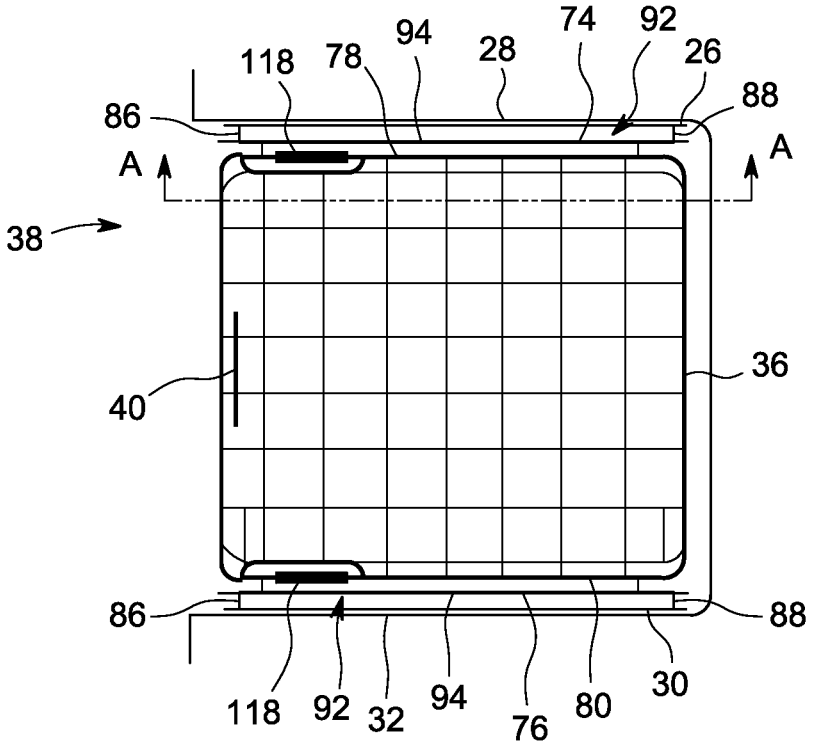
Figure 5:
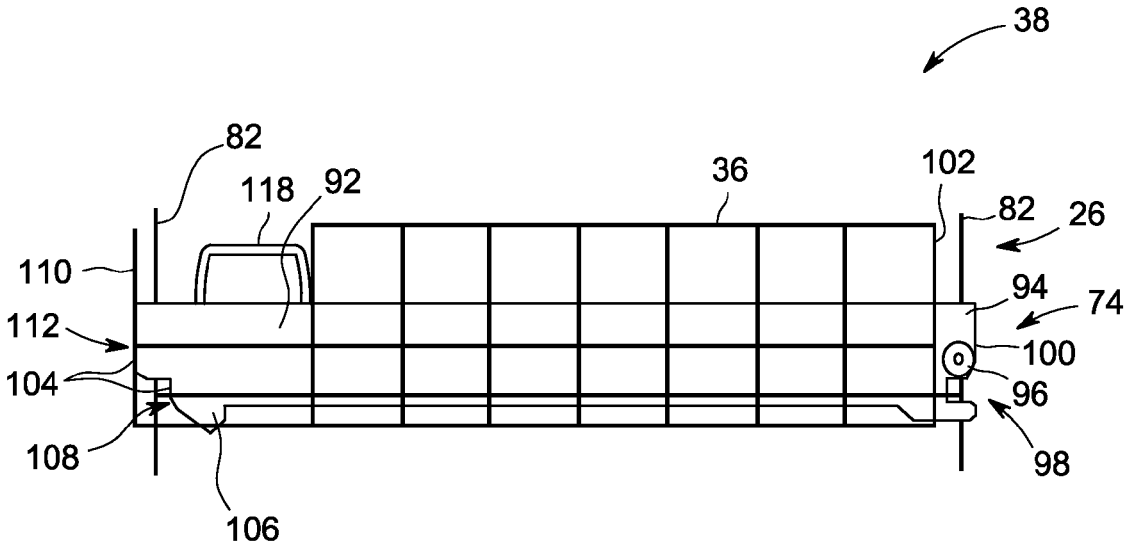

FIG. 3 is a side perspective view of first rail assembly 26; however, it should be understood that second rail assembly 30 is substantially similar to first rail assembly 26 and the description of first rail assembly 26 applies to second rail assembly 30. FIG. 4 is a top view of adjustable rack assembly 38, and FIG. 5 is a cross-sectional view of adjustable rack assembly 38 taken along line A-A in FIG. 4. Referring to FIGS. 1-5, in the exemplary embodiment, adjustable rack assembly 38 includes rail assemblies 26 and 30, upper rack 36, and at least one support assembly 74 and/or 76. Although adjustable rack assembly 38 is described as being used with upper rack 36, it should be understood that adjustable rack assembly 38 can be used with lower rack 46 and/or a middle rack, if present. In the exemplary embodiment, rail assemblies 26 and 30 are coupled to side walls 28 and 32 of tub 14, respectively, and support assemblies 74 and 76 removably couple upper rack 36 to rail assemblies 26 and 30. More specifically, a first support assembly 74 is coupled to a first side wall 78 of rack 36, and a second support assembly 76 is coupled to a second side wall 80 of rack 36. Support assemblies 74 and 76 are mirror images of each other and, as such, the description of one support assembly 74 or 76 also applies to the other support assembly 76 or 74.

Each rail assembly 26 and 30 includes a pair of substantially vertical supports 82 and a plurality of substantially horizontal rails 84. Although four horizontal rails 84 are shown in the figures, it should be understood that rail assembly 26 and/or 30 includes any suitable number of horizontal rails 84 that enables adjustable rack assembly 38 to function as described herein. In a particular embodiment, rail assembly 26 and/or 30 includes at least two horizontal rails 84. In the exemplary embodiment, each rail assembly 26 and 30 includes the same number of horizontal rails 84. Further, in the exemplary embodiment, horizontal rails 84 are offset from vertical supports 82 by a pair of extensions 86 and 88. Extensions 86 and 88 are sized to space horizontal rails 84 from a respective side wall 28 or 32 when rail assembly 26 and/or 30 is coupled to one of side walls 28 or 32. Further, horizontal rails 84 are spaced apart from at least one adjacent horizontal rail 84 by a distance D in a vertical direction. Spacing between horizontal rails 84 enables rack 36 to be positioned at different heights within tub 14. It should be understood that the spacing between horizontal rails 84 can each be substantially equidistant or at least one distance between horizontal rails 84 can be different than another distance between horizontal rails 84. In the exemplary embodiment, vertical supports 82 include attachment mechanisms 90 configured to enable rail assembly 26 and/or 30 to be coupled to side wall 28, side wall 32, and/or top wall 34. In a particular embodiment, attachment mechanism 90 enables rail assembly 26 and/or 30 to be bolted, screwed, and/or otherwise coupled to wall 28, 32, and/or 34.

Adjustable rack assembly 38 further includes support assemblies 74 and 76 each having a slide assembly 92 and a support plate 94. In the exemplary embodiment, support plates 94 are configured to removably couple rack 36 to an opposing pair of horizontal rails 84. More specifically, each support plate 94 includes a rear roller or wheel 96 and a locking notch 98 defined along a rear edge 100 of support plate 94 below rear wheel 96. Rear wheel 96 is configured to roll along horizontal rails 84, and locking notch 98 is configured to secure rack 36 to horizontal rail 84. Further, rear edge 100 is offset outwardly from a rear edge 102 of rack 36; although, it should be understood that rear edge 100 can have any suitable configuration that enables adjustable rack assembly 38 to function as described herein. Adjacent a front edge 104 of each support plate 94, a projection 106 extends downward from support plate 94. Projection 106 is configured to prevent rack 36 from inadvertently being removed from horizontal rails 84. Alternatively, support plate 94 does not include projection 106. In the exemplary embodiment, at least a portion 108 of front edge 104 adjacent projection 106 does not extend to a front edge 110 of rack 36, and a remainder 112 of front edge 104 extends to front edge 110 of rack 36. Alternatively, front edge 104 has any suitable configuration that enables adjustable rack assembly 38 to function as described herein.

In the exemplary embodiment, each support plate 94 further includes a base 114 (shown in FIG. 7) configured to rest against a top surface 116 of horizontal rail 84. Base 114 is located adjacent front edge 104 and rear edge 100. Alternatively, base 114 extends along at least a portion of a length of support plate 94. In the exemplary embodiment, a handle 118 is coupled to support plate 94 and extends upwardly from support plate 94. Alternatively, handle 118 is coupled to rack 36 or is omitted. In the exemplary embodiment, handles 118 are configured to facilitate selectively positioning rack 36 on rail assemblies 26 and 30, as described in more detail below. Further, slide assembly 92 couples rack 36 to support plate 94 and enables rack 36 to move with respect to support plate 94. More specifically, rack 36 is slidably movable with respect to support plate 94 via slide assembly 92. In the exemplary embodiment, support plate 94 enables height adjustment of rack 36 on rail assemblies 26 and 30, and slide assembly 92 enables rack 36 to be moved between the retracted position and the extended position, as described in more detail below.

Figure 6:
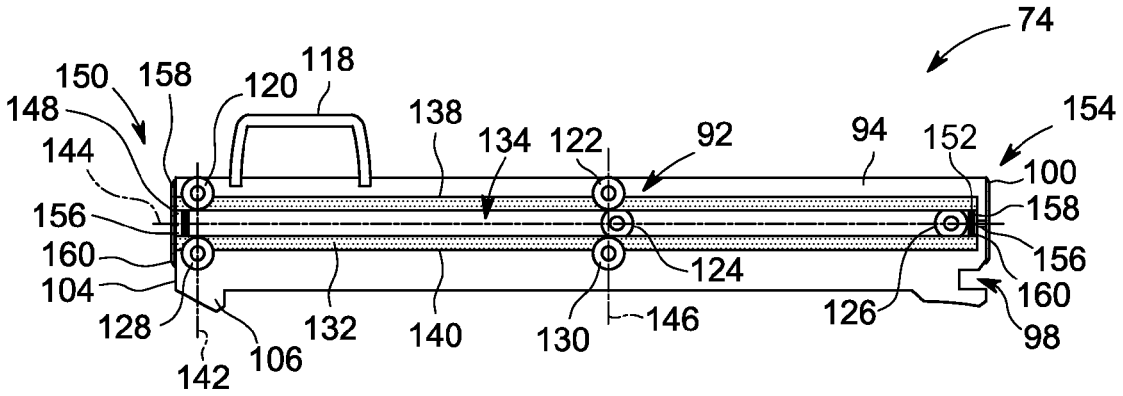
Figure 7:
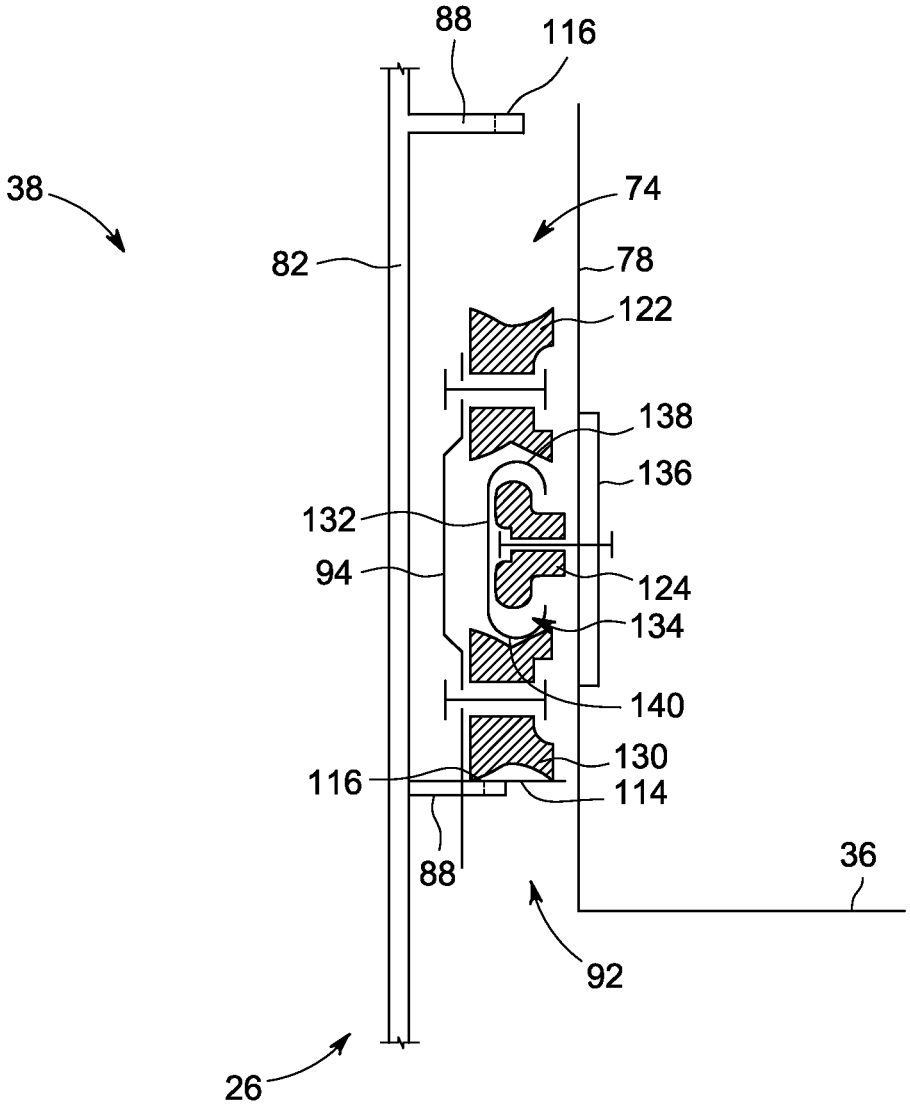

FIG. 6 is a side view of support assembly 74 that may be used with adjustable rack assembly 38 (shown in FIGS. 1-5). In FIG. 6, support plate 94 is transparent at slide assembly 92 to show details of slide assembly 92 with respect to support plate 94. FIG. 7 is a cross-sectional view of support assembly 74. Referring to FIGS. 6 and 7, in the exemplary embodiment, slide assembly 92 includes at least one upper roller 120 and/or 122, at least one central roller 124 and/or 126, at least one lower roller 128 and/or 130, and a bracket 132. In the exemplary embodiment, bracket 132 is C-shaped and defines a channel 134. Central roller 124 and/or 126 is positioned within channel 134 and is configured to roll through channel 134. Further, central roller 124 and/or 126 is coupled to side wall 78 or 80 of rack 36 at a reinforcement 136. Alternatively, rack 36 does not include reinforcement 136. In the exemplary embodiment, as central roller 124 and/or 126 moves with respect to bracket 132, rack 36 moves into or out of tub 14. Further, in the exemplary embodiment, slide assembly 92 includes a first central roller 124 coupled near a center of side wall 78 or 80 and a second central roller 126 coupled adjacent rear edge 102 of side wall 78 or 80.

Upper roller 120 and/or 122 and lower roller 128 and/or 130 are each coupled to support plate 94. Upper roller 120 and/or 122 is configured to roll along an upper surface 138 of bracket 132, and lower roller 128 and/or 130 is configured to roll along a lower surface 140 of bracket 132. Further, lower roller 128 and/or 130 rolls along base 114 of support plate 94. Alternatively, lower roller 128 and/or 130 is in contact with either lower surface 140 or base 114. In the exemplary embodiment, slide assembly 92 includes a first upper roller 120, a second upper roller 122, a first lower roller 128, and a second lower roller 130. More specifically, first upper roller 120 and first lower roller 128 are coupled to support plate 94 adjacent front edge 104, and second upper roller 122 and second lower roller 130 are coupled to support plate 94 near a mid-point of the length of support plate 94. Further, first upper roller 120 and first lower roller 128 are substantially aligned with each other along a first line 142 that is substantially perpendicular to an axis 144 of bracket 132. Similarly, second upper roller 122 and second lower roller 130 are substantially aligned with each other along a second line 146 that is substantially perpendicular to axis 144 of bracket 132. In the exemplary embodiment, second line 146 is slightly forward of first central roller 124; however, second line 146 may be located at any suitable position along bracket 132. Further, it should be understood that roller 120, 122, 124, 126, 128, and/or 130 can be located at any suitable position that enables slide assembly 92 to function as described herein.

In the exemplary embodiment, a first end stop 148 is coupled to a forward end 150 of bracket 132, and a second end stop 152 is coupled to a rear end 154 of bracket 132. Each end stop 148 and 152 includes a plug portion 156, an upper arm 158, and a lower arm 160. Plug portions 156 are configured to prevent central rollers 124 and/or 126 from being removed from channel 134, upper arms 158 are configured to prevent upper rollers 120 and/or 122 from being removed from bracket 132, and lower arms 160 are configured to prevent lower rollers 128 and/or 130 from being removed from bracket 132. Alternatively, slide assembly 92 includes any suitable components and/or mechanism that prevent slide assembly from being inadvertently disassembled during movement of rack 36 between the retracted position and the extended position. Further, although slide assembly 92 is described herein, it should be understood that any suitable slide assembly can be used with adjustable rack assembly 38.

Figure 8:
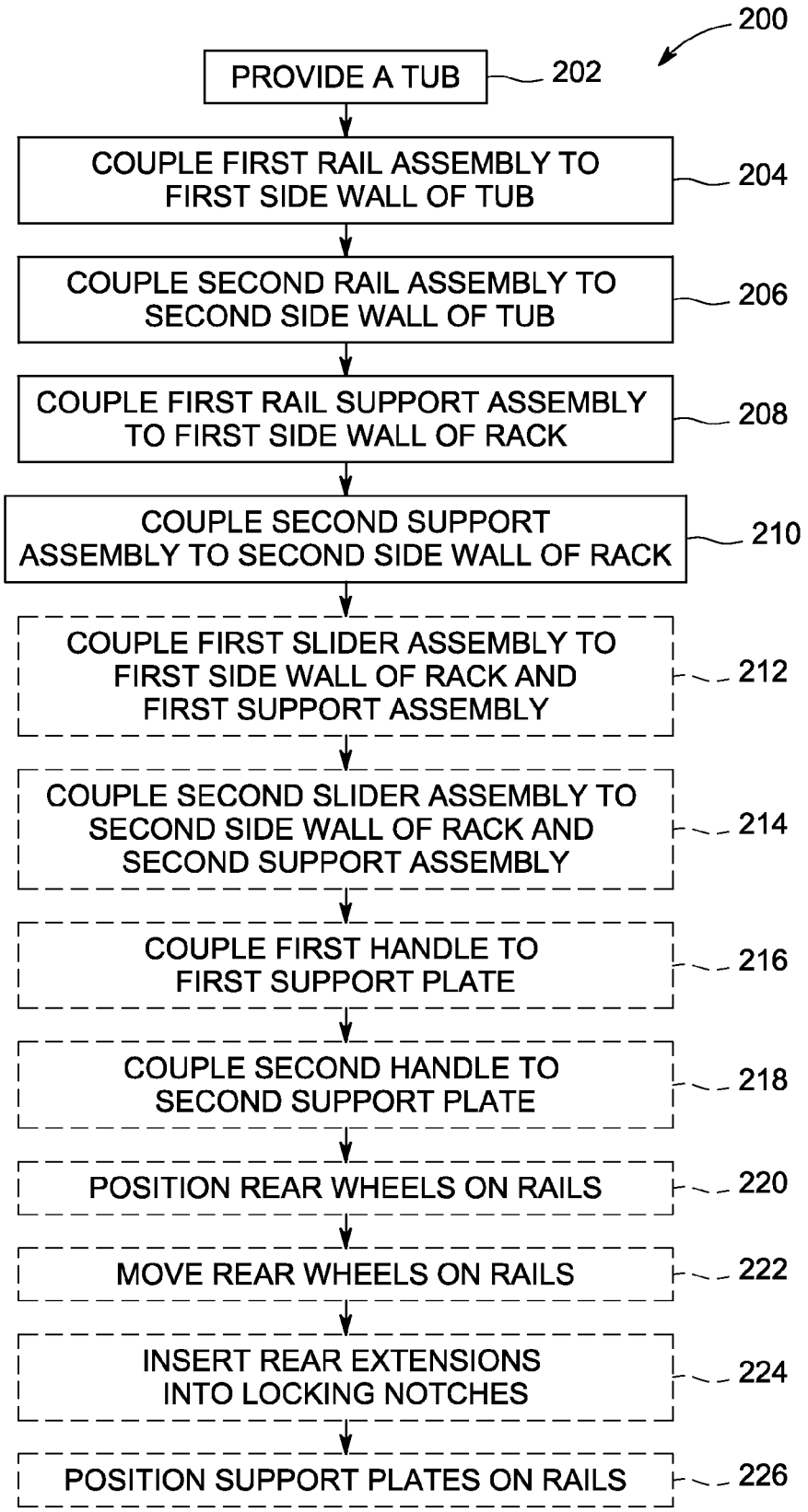

FIG. 8 is a flowchart illustrating an exemplary method 200 for manufacturing washing appliance 10 shown in FIGS. 1-7. Referring to FIGS. 1-8, to manufacture or make washing appliance 10, tub 14 is provided 202. First rail assembly 26 is coupled 204 to first side wall 28, and second rail assembly 30 is coupled 206 to second side wall 32. More specifically, attachment mechanisms 90 are coupled to side walls 28 and 32. In the exemplary embodiment, rail assemblies 26 and 30 are coupled 204, 206 to side walls 28 and 32 such that each horizontal rail 84 of first rail assembly 26 is aligned with a respective horizontal rail 84 of second rail assembly 30. The alignment of horizontal rails 84 ensures that rack 36 is substantially horizontal and/or level within tub 14.

First support assembly 74 is coupled 208 to first side wall 78 of rack 36, and second support assembly 76 is coupled 210 to second side wall 80 of rack 36. The first support 94 plate is configured to couple 212 to the first side wall 78 of the rack via a first slide assembly 92 and said second support plate 94 is configured to couple 214 to the second side wall 80 of the rack 36 via a second slide assembly 92. The first slide assembly 92 and the second slide assembly 92 each include a bracket 132 defining a channel 134, and a plurality of rollers configured to roll along the bracket 132. The plurality of rollers has at least one upper roller 120, 122, at least one lower roller 128, 130, and at least one central roller 124, 126. The at least one central roller 124, 126 is positioned within the channel 134. The at least one upper roller 120, 122 is positioned adjacent an upper surface 138 of the bracket 134. The at least one lower roller 128, 130 is positioned adjacent a lower surface 140 of the bracket 134. End stops 148 and 152 are coupled to ends 150 and 154, respectively, of each bracket 132. A handle 118 is coupled 216, 218 to each support plate 94. Alternatively, handle 118 is formed integrally with support plate 94 and/or rack 36.

In the exemplary embodiment, rack 36 is removably coupled to rail assemblies 26 and 30 using support plates 94. More specifically, support plate 94 of first support assembly 74 is coupled to a first horizontal rail 162 of first rail assembly 26, and support plate 94 of second support assembly 76 is coupled to a first horizontal rail 164 of second rail assembly 30. First horizontal rails 162 and 164 are aligned such that rack 36 is substantially horizontal within tub 14. A height of rack 36 within tub 14 is adjusted by removing rack 36 from first horizontal rails 162 and 164 and positioning rack 36 on a second horizontal rail 166 of first rail assembly 26 and a second horizontal rail 168 of second rail assembly 30. Although second horizontal rails 166 and 168 are indicated as specific rails in the figures, it should be understood that rack 36 can be moved to any opposing set of rails 84 of rail assemblies 26 and 30 to adjust the height of rack 36 within tub 14.

To removably couple rack 36 to rail assemblies 26 and 30, rear wheels 96 are positioned 220 on first horizontal rails 162 and 164. Rear wheels 96 are moved 222 with respect to first horizontal rails 162 and 164 to insert rack 36 into tub 14. In the exemplary embodiment, rear wheels 96 roll along top surfaces 116 of first horizontal rails 162 and 164 during insertion of rack 36. Rear extensions 88 associated with first horizontal rails 162 and 164 are inserted 224 into each locking notch 98. Support plates 94 are positioned 226 on first horizontal rails 162 and 164 such that projections 106 are positioned behind front extensions 86 associated with first horizontal rails 162 and 164. More specifically, bases 114 rest on first horizontal rails 162 and 164 to support rack 36 within tub 14.

Figure 9:
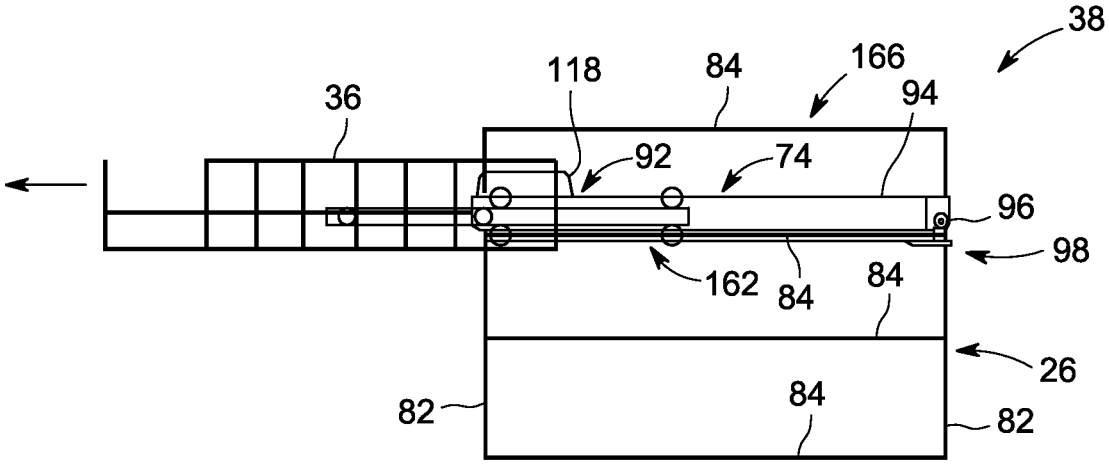
Figure 10:
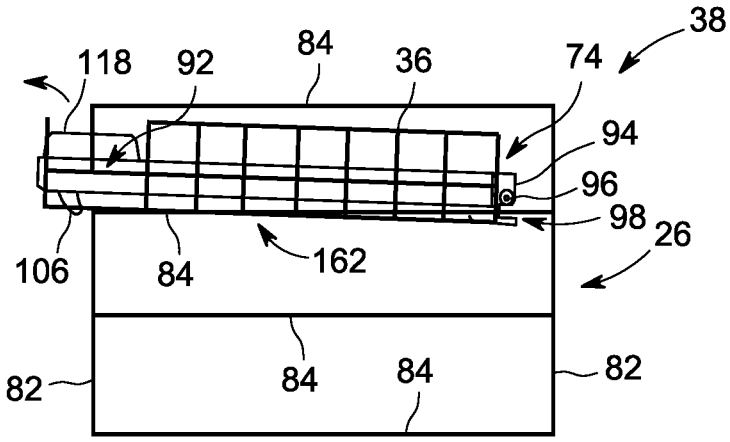

FIG. 9 is a side view of adjustable rack assembly 38 in an extended position, and FIG. 10 is a side view of adjustable rack assembly 38 in a removable position. Referring to FIGS. 6, 9, and 10, during operation of washing appliance 10, rack 36 and/or 46 is moved to the extended position to load items to be washed. When upper rack 36 is moved the extended position, upper rollers 120 and 122 and lower rollers 128 and 130 move along surfaces 138 and 140 of brackets 132, and central rollers 124 and 126 move along channel 134. End stops 148 and 152 prevent rollers 120, 122, 124, 126, 128, and/or 130 from inadvertently being removed from bracket 132. When the items have been loaded on to upper rack 36, slide assemblies 92 enable upper rack 36 to be inserted into tub 14 to the retracted position.

When a user would like to adjust the height of upper rack 36, the user grasps handles 40 and/or 118 and lifts front edge 110 of rack 36 upward from horizontal rails 162 and 164 to disengage projections 106 from rails 162 and 164. Rack 36 is moved forward along rails 162 and 164 to disengage locking notches 98 from extensions 88. As rack 36 is moved forward, rear wheels 96 rolls along rails 162 and 164. When locking notches 98 are adjacent front extensions 86, the user lifts rack 36 from rails 162 and 164. The user selects second horizontal rails 166 and 168 at a desired height, and removably couples rack 36 to second horizontal rails 166 and 168, as described in more detail above. When rack 36 has been removed from tub 14, handles 118 allow the user to transport rack 36 for use as an external rack during loading or unloading.

The embodiments described herein provide an adjustable rack assembly that enables height adjustment of a rack within a tub of a washing appliance. As such, the washing appliance described herein provides more flexibility than known washing appliances provide. For example, depending on sizes of items positioned in an upper rack and/or a lower rack, a height of at least the upper rack can be adjusted upwardly or downwardly. During adjustment of the above-described rack, the rack is removed from the tub. As such, the rack can be used as an external rack during loading of items to be washed or during unloading of washed items. Further, the adjustable rack assembly includes slide assemblies that allow the rack to be moved to an extended position for loading and unloading without removing the rack from the tub.

Exemplary embodiments of an adjustable rack assembly for use with a washing appliance and method for making the same are described above in detail. The apparatus and method are not limited to the specific embodiments described herein, but rather, components of systems and/or steps of the methods may be utilized independently and separately from other components and/or steps described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An adjustable rack assembly for use with a washing appliance, said adjustable rack assembly comprising:

a rack comprising a first side wall and an opposing second side wall;

a first rail assembly comprising a first plurality of horizontal rails;

a second rail assembly comprising a second plurality of horizontal rails;

a first support assembly coupled to said first side wall of said rack and comprising a first support plate configured to be removably coupled to said first rail assembly at any horizontal rail of said first plurality of horizontal rails; and a second support assembly coupled to said second side wall of said rack and comprising a second support plate configured to be removably coupled to said second rail assembly at any horizontal rail of said second plurality of horizontal rails;

wherein said first support plate comprises a projection configured to extend downward and between any horizontal rail of said first plurality of horizontal rails and a first side wall of a tub of the washing appliance, and said second support plate comprises a projection configured to extend downward and between any horizontal rail of said second plurality of horizontal rails and a second side wall of the tub of the washing appliance, to secure said rack to said first rail assembly and said second rail assembly, and wherein each horizontal rail of said first plurality of horizontal rails and said second plurality of horizontal rails defines an extension, and said first support plate comprises a locking notch defined in a rear edge thereof and configured to couple to the respective extension of any horizontal rail of said first plurality horizontal rails, and said second support plate comprises a locking notch defined in a rear edge thereof and configured to couple to the respective extension of any horizontal rail of said second plurality of horizontal rails.

2. An adjustable rack assembly in accordance with claim 1, wherein said first support plate and said second support plate each comprise a rear wheel configured to move along each horizontal rail of said first plurality of horizontal rails and said second plurality of horizontal rails.

3. An adjustable rack assembly in accordance with claim 1, wherein said first support plate is coupled to said first side wall of said rack via a first slide assembly and said second support plate is coupled to said second side wall of said rack via a second slide assembly, said first slide assembly and said second slide assembly configured to enable movement of said rack between a retracted position and an extended position.

4. An adjustable rack assembly in accordance with claim 3, wherein said first slide assembly and said second slide assembly each comprise a plurality of rollers and a bracket, said plurality of rollers configured to roll along said bracket.

5. An adjustable rack assembly in accordance with claim 4, wherein said plurality of rollers comprises at least one upper roller, at least one lower roller, and at least one central roller, said at least one central roller positioned within a channel defined by said bracket, said at least one upper roller positioned adjacent an upper surface of said bracket, said at least one lower roller positioned adjacent a lower surface of said bracket.

6. A washing appliance comprising:

a tub comprising a first side wall and a second side wall, said tub in flow communication with a water source; and an adjustable rack assembly coupled within said tub, said adjustable rack assembly comprising:

a rack comprising a first side wall and an opposing second side wall;

a first rail assembly coupled to said first side wall of said tub, said first rail assembly comprising a first plurality of horizontal rails;

a second rail assembly coupled to said second side wall of said tub, said second rail assembly comprising a second plurality of horizontal rails;

a first support assembly coupled to said first side wall of said rack and comprising a first support plate configured to be removably coupled to said first rail assembly at any horizontal rail of said first plurality of horizontal rails; and a second support assembly coupled to said second side wall of said rack and comprising a second support plate configured to be removably coupled to said second rail assembly at any horizontal rail of said second plurality of horizontal rails;

wherein said first support plate comprises a projection configured to extend downward and between any horizontal rail of said first plurality of horizontal rails and said first side wall of the tub and said second support plate comprises a projection configured to extend downward and between any horizontal rail of said second plurality of horizontal rails and said second side wall of the tub, to secure said rack to said first rail assembly and said second rail assembly, and wherein each horizontal rail of said first plurality of horizontal rails and said second plurality of horizontal rails defines an extension, and said first support plate comprises a locking notch defined in a rear edge thereof and configured to couple to the respective extension of any horizontal rail of said first plurality horizontal rails, and said second support plate comprises a locking notch defined in a rear edge thereof and configured to couple to the respective extension of any horizontal rail of said second plurality of horizontal rails.

7. A washing appliance in accordance with claim 6, wherein said first support plate is coupled to said first side wall of said rack via a first slide assembly and said second support plate is coupled to said second side wall of said rack via a second slide assembly, said first slide assembly and said second slide assembly configured to enable movement of said rack between a retracted position and an extended position.

8. A washing appliance in accordance with claim 7, wherein said first slide assembly and said second slide assembly each comprise a plurality of rollers and a bracket, said plurality of rollers configured to roll along said bracket.

9. A washing appliance in accordance with claim 8, wherein said plurality of rollers comprises at least one upper roller, at least one lower roller, and at least one central roller, said at least one central roller positioned within a channel defined by said bracket, said at least one upper roller positioned adjacent an upper surface of said bracket, and said at least one lower roller positioned adjacent a lower surface of said bracket.

10. A washing appliance comprising:

a tub comprising a first side wall and a second side wall, said tub in flow communication with a water source; and an adjustable rack assembly coupled within said tub, said adjustable rack assembly comprising:

a rack comprising a first side wall and an opposing second side wall;

a first rail assembly coupled to said first side wall of said tub, said first rail assembly comprising a first plurality of horizontal rails;

a second rail assembly coupled to said second side wall of said tub, said second rail assembly comprising a second plurality of horizontal rails;

a first support assembly coupled to said first side wall of said rack and comprising a first support plate configured to be removably coupled to said first rail assembly at any horizontal rail of said first plurality of horizontal rails; and a second support assembly coupled to said second side wall of said rack and comprising a second support plate configured to be removably coupled to said second rail assembly at any horizontal rail of said second plurality of horizontal rails;

wherein said first rail assembly and said second rail assembly each comprise:

vertical supports configured to couple to one of said first side wall of said tub and said second side wall of said tub, said first plurality of horizontal rails spaced apart along said vertical supports of said first rail assembly and said second plurality of horizontal rails spaced apart along said vertical supports of said second rail assembly; and extensions extending between each said vertical support and each horizontal rail, said extensions configured to space each horizontal rail of said first plurality of horizontal rails from said first side wall of said tub and to space each horizontal rail of said second plurality of horizontal rails from said second side wall of said tub.

11. An adjustable rack assembly for use with a washing appliance, said adjustable rack assembly including a rack having a first side wall and an opposing second side wall, said adjustable rack assembly comprising:

a first rail assembly comprising a first plurality of horizontal rails;

a second rail assembly comprising a second plurality of horizontal rails;

a first support assembly configured to couple to the first side wall of the rack and comprising a first support plate configured to be removably coupled to said first rail assembly at any horizontal rail of said first plurality of horizontal rails; and a second support assembly configured to couple to the second side wall of the rack and comprising a second support plate configured to be removably coupled to said second rail assembly at any horizontal rail of said second plurality of horizontal rails;

wherein said first support plate comprises a projection configured to extend downward and between any horizontal rail of said first plurality of horizontal rails and said first side wall of a tub of the washing appliance, and said second support plate comprises a projection configured to extend downward and between any horizontal rail of said second plurality of horizontal rails and said second side wall of the tub of the washing appliance to secure said rack, to said first rail assembly and said second rail assembly, and wherein each horizontal rail of said first plurality of horizontal rails and said second plurality of horizontal rails defines an extension, and said first support plate comprises a locking notch defined in a rear edge thereof and configured to couple to the respective extension of any horizontal rail of said first plurality horizontal rails, and said second support plate comprises a locking notch defined in a rear edge thereof and configured to couple to the respective extension of any horizontal rail of said second plurality of horizontal rails.

12. An adjustable rack assembly in accordance with claim 11, wherein said first support plate is configured to couple to the first side wall of the rack via a first slide assembly and said second support plate is configured to couple to the second side wall of the rack via a second slide assembly, wherein said first slide assembly and said second slide assembly each comprise:

a bracket defining a channel; and a plurality of rollers configured to roll along said bracket, wherein said plurality of rollers comprises at least one upper roller, at least one lower roller, and at least one central roller, said at least one central roller positioned within said channel, said at least one upper roller positioned adjacent an upper surface of said bracket, said at least one lower roller positioned adjacent a lower surface of said bracket.

* * * * *

UNITED STATES PATENT AND TRADEMARK OFFICE

CERTIFICATE OF CORRECTION

PATENT NO. : 8,757,742 B2
APPLICATION NO. : 12/957943
DATED : June 24, 2014
INVENTOR(S) : McDaniel It is certified that error appears in the above-identified patent and that said Letters Patent is hereby corrected as shown below:

In the Specification

In Column 7, Line 33, delete "bracket 134." and insert -- bracket 132. --, therefor.

In Column 7, Line 35, delete "bracket 134." and insert -- bracket 132. --, therefor.

Signed and Sealed this
Thirtieth Day of September, 2014

Michelle K. Lee

Michelle K. Lee
*Deputy Director of the United States Patent and Trademark Office*